US008864534B2

(12) United States Patent
Midy

(10) Patent No.: US 8,864,534 B2
(45) Date of Patent: Oct. 21, 2014

(54) DOUBLE-LOCKING SOCKET FOR AN ELECTRIC BULB

(75) Inventor: Olivier Midy, Rochefort sur Loire (FR)

(73) Assignee: TBI, Les Neyrolles (FR)

( * ) Notice: Subject to any disclaimer, the term of this patent is extended or adjusted under 35 U.S.C. 154(b) by 208 days.

(21) Appl. No.: 13/642,067

(22) PCT Filed: Apr. 15, 2011

(86) PCT No.: PCT/FR2011/050874

§ 371 (c)(1),
(2), (4) Date: Jan. 2, 2013

(87) PCT Pub. No.: WO2011/131894

PCT Pub. Date: Oct. 27, 2011

(65) Prior Publication Data

US 2013/0102204 A1 Apr. 25, 2013

(30) Foreign Application Priority Data

Apr. 20, 2010 (FR) ..... 10 52973

(51) Int. Cl.

| | |
|---|---|
| ***H01R 33/94*** | (2006.01) |
| ***H01R 33/09*** | (2006.01) |
| ***H01R 13/74*** | (2006.01) |
| *H01R 4/18* | (2006.01) |
| *H01R 13/432* | (2006.01) |

(52) U.S. Cl.

CPC ..... *H01R 33/94* (2013.01); *H01R 33/09* (2013.01); *H01R 4/183* (2013.01); *H01R 13/432* (2013.01); *H01R 13/743* (2013.01)

USPC ..... 439/851

(58) Field of Classification Search

CPC .... H01R 13/111; H01R 13/11; H01R 13/113; H01R 13/187; H01R 43/16; H01R 33/09; H01R 33/94

USPC ..... 439/851, 548, 815, 528, 699.1; 307/10.1

See application file for complete search history.

(56) References Cited

U.S. PATENT DOCUMENTS

| | | | | |
|---|---|---|---|---|
| 3,573,722 | A * | 4/1971 | DeLano et al. | 439/825 |
| 4,393,561 | A * | 7/1983 | Yuda | 24/297 |
| 4,506,419 | A * | 3/1985 | Mitomi | 24/297 |

(Continued)

FOREIGN PATENT DOCUMENTS

| | | |
|---|---|---|
| CA | 1 200 297 | 2/1986 |
| DE | 10 303 329 | 9/2003 |

(Continued)

*Primary Examiner* — Amy Cohen Johnson
*Assistant Examiner* — Vladimir Imas
(74) *Attorney, Agent, or Firm* — Harness, Dickey & Pierce, P.L.C.

(57) ABSTRACT

The present disclosure relates to a socket for an electric bulb, formed by a tubular body having two longitudinal cavities for receiving contacts crimped onto cables, said tubular body including lateral clip-fastening elements having lugs for locking into the base of a motor vehicle light or headlight. The disclosure provides that the locking elements are provided with internal shoulders having dimensions and positions configured such as: to be engaged behind a transverse surface of the contact when said contact is correctly mounted and to allow insertion into the base of the light or headlight when the clip-fastening elements are biased; and to prevent the movement of the elements which would allow insertion of the socket when the contact has not been correctly engaged.

9 Claims, 4 Drawing Sheets

(56) References Cited

U.S. PATENT DOCUMENTS

| | | | | | |
|---|---|---|---|---|---|
| 4,546,761 | A | * | 10/1985 | McCullough | 600/184 |
| 4,664,465 | A | * | 5/1987 | Johnson et al. | 439/572 |
| 4,772,229 | A | | 9/1988 | Nix et al. | |
| 5,078,625 | A | | 1/1992 | Anzai | |
| 5,168,604 | A | * | 12/1992 | Boville | 24/297 |
| 5,350,311 | A | | 9/1994 | Roy et al. | |
| 5,490,802 | A | | 2/1996 | Plyler et al. | |
| 5,597,278 | A | * | 1/1997 | Peterkort | 411/134 |
| 5,605,471 | A | | 2/1997 | Plyler | |
| 5,607,230 | A | * | 3/1997 | Protz, Jr. | 362/396 |
| 5,681,184 | A | | 10/1997 | Pamart et al. | |
| 5,842,769 | A | | 12/1998 | Muller et al. | |
| 5,951,318 | A | | 9/1999 | Harada | |
| 6,318,991 | B1 | | 11/2001 | Kawase | |
| 7,198,496 | B2 | | 4/2007 | Yamamoto | |
| 7,364,382 | B2 | * | 4/2008 | Benedetti et al. | 403/388 |
| 7,712,938 | B2 | * | 5/2010 | Behr et al. | 362/549 |
| 8,684,321 | B2 | * | 4/2014 | Shirakabe et al. | 248/74.1 |
| 2006/0052010 | A1 | * | 3/2006 | Dietz et al. | 439/699.2 |
| 2009/0080212 | A1 | * | 3/2009 | Behr et al. | 362/548 |
| 2009/0203254 | A1 | * | 8/2009 | Weber et al. | 439/541 |
| 2009/0269963 | A1 | | 10/2009 | Brown et al. | |
| 2013/0043230 | A1 | * | 2/2013 | Schwarzbach et al. | 219/202 |

FOREIGN PATENT DOCUMENTS

| | | | |
|---|---|---|---|
| FR | 2 723 802 | A1 | 2/1996 |
| FR | 2 739 229 | | 3/1997 |
| FR | 2 769 972 | | 4/1999 |
| FR | 2 807 142 | | 10/2001 |
| FR | 2 835 593 | | 8/2003 |
| FR | 2 835 594 | | 8/2003 |
| FR | 2 835 595 | | 8/2003 |
| FR | 2 836 984 | | 9/2003 |
| FR | 2 860 858 | | 4/2005 |
| FR | 2 861 508 | | 4/2005 |
| FR | 2 873 503 | | 1/2006 |
| FR | 2 882 424 | | 8/2006 |
| GB | 1 224 570 | | 3/1971 |
| WO | WO 86/06555 | A1 | 11/1986 |
| WO | WO 2011/007096 | | 1/2011 |
| WO | WO 2011/007098 | | 1/2011 |

* cited by examiner

DOUBLE-LOCKING SOCKET FOR AN ELECTRIC BULB

CROSS-REFERENCE TO RELATED APPLICATIONS

This application is a National Phase Entry of International Application No. PCT/FR2011/050874, filed on Apr. 15, 2011, which claims priority to French Patent Application Serial No. 10/52973, filed on Apr. 20, 2010, both of which are incorporated by reference herein.

FIELD OF THE INVENTION

The present invention relates to the field of sockets for wedge-base filament lamps. More specifically, the invention relates to a socket for wedge-base lamps suitable for use in lighting and/or signalling devices for motor vehicles, in particular signalling lights. Said clip-fastening sockets are in the base of the light or headlight, and receiving wedge-base lamps powered by means of contacts crimped onto electric cables.

BACKGROUND

Prior sockets consist of an insulating tubular body made of moulded plastic. The sockets are intended for receiving W5W type lamps, for the nightlight function in motor vehicle headlights. The sockets have, in a known manner, two longitudinal cavities into which are inserted electrical contacts crimped onto power supply cables. The socket according to the prior art is inserted into the base of the headlight, which has in relation thereto an opening. The socket known in the prior art has resiliently deformable lateral elements, with external shoulders for providing the clip-fastening.

The sockets are used in the following manner: the lamp is inserted into the socket by pushing it such that the base and the electrical contacts are engaged onto the contacts of the socket. The socket supporting the bulb is then engaged into the headlight. In particular, European patent EP0404135B1 describes a socket intended to be mounted on an electrically insulating substrate. The socket according to the patent comprises hook-shaped electrical contact studs and a casing intended for holding the base of the lamp in the socket.

Patent application EP1633024 also describes a socket for a wedge-base lamp comprising a base and at least two electrical contact studs which are fitted in the base in order to connect electrodes of the lamp electrically to an electric supply circuit, the electrical contact studs each comprising a resilient part which forms a gripper into which the wedge base of the lamp is inserted. In the document, the base comprises a centering part which is produced in the form of a ring, which is extended on a first surface by at least one element which can provide a fixed positioning of the centering part. On a second surface, centering elements form a part in contact with the base of the bulb of the lamp in order to center the lamp in a predetermined manner in the base and to oppose displacement of the lamp relative to the base. It is also known by European patent EP066863 to have a bulb socket comprising a W5W type bulb receptacle.

The sockets according to the prior art have the disadvantage of enabling mounting with an imperfect electrical connection. It may arise that one of the crimped contacts is not correctly locked into the cavity of the socket, which causes electric supply faults of the lamp. Even if a prior electrical inspection is carried out, the imperfect locking may result in that the lamp is temporarily considered transitorily as correctly powered, and then, after shaking or vibration, breaks free.

SUMMARY

The aim of the present invention is to remedy the prior disadvantages by proposing an improved socket, preventing mounting of the socket onto the headlight when the electrical contact is not completely engaged. In addition, the invention provides an additional advantage by enabling a double locking of the contacts to be provided once the socket is mounted onto the headlight. In relation thereto, the present invention, according to the more general acceptance thereof, relates to a socket for an electric bulb formed by a tubular body having two longitudinal cavities for receiving contacts crimped onto a cable, the tubular body having lateral clip-fastening elements having shoulders for locking into the base of a motor vehicle light or headlight, the locking elements have internal shoulders the dimensions and the positioning of which are configured such as to be engaged behind a transverse surface of the contact, when the contact is correctly mounted and when the element is biased to enable insertion into the base of the light or headlight, and to prevent the movement of the element for the insertion of the socket, when the contact is not correctly engaged.

Advantageously, the shoulder of the element frees the passage of the cavity at rest. Preferably, the shoulder of the element is configured to provide the locking of the contacts by the combination between the transverse surface of the shoulder and the transverse surface of the contact, when the contact is correctly engaged in the socket and when the socket is clip-fastened into the base of the light or headlight. According to a first variant, the elements are moulded in expanded position, and have resilient hooks engaging in a complementary area of the tubular body during the first transverse biasing on the elements. According to a second variant, the elements are moulded in expanded position, and have rigid hooks engaging in a resilient complementary area of the tubular body during the first transverse biasing on the elements.

BRIEF DESCRIPTION OF THE DRAWINGS

The present invention will be described in the following according to an example of non-limitative embodiment, while referring to the appended drawings wherein.

DETAILED DESCRIPTION

Figure 1:
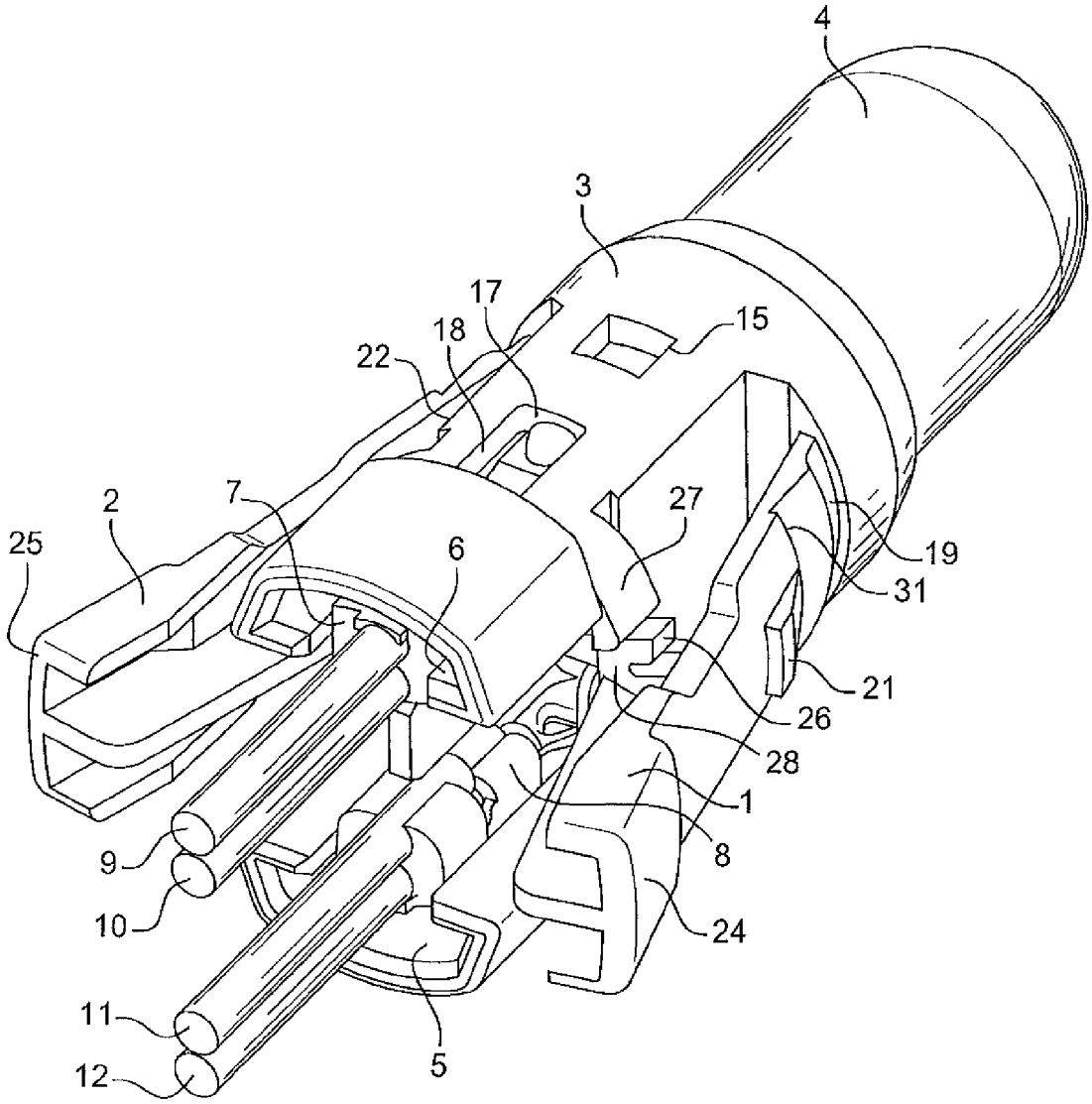
FIG. 1 shows a three-quarter rear view of a socket according to the invention.

FIG. 1 shows a view of the socket, after engagement of the contacts and before the first biasing of the lateral elements (1, 2) extending on either side of a substantially tubular insulating body. FIG. 1 shows a schematic diagram of a bulb (4), in a position that it would have after the final assembly.

The socket is produced by moulding in a mould with two moulding directions only. The front part of the tubular body (3) has a cross-sectional cavity complementary to that of the bulb (4). To the rear, the socket has two longitudinal cavities (5, 6) arranged on either side of the main axis. The cavities (5, 6) are intended for receiving the crimped contacts (7, 8). In the example described, the contacts are each crimped onto two power supply wires (9, 10, 11, 12) forming a bundle for powering other equipment. The contact (8), shown in a more visible manner in FIG. 2, is produced by cutting and folding a resilient copper alloy sheet.

It has a front part (13) forming a gripper or bracket that is fixed on the base of the bulb (4) such as to provide the power supply of one of the electrical terminals of the bulb. The front part (13) has a resiliently deformable locking nose (14). The nose (14) is lodged in a housing (15) provided on the tubular body (3), when the contact is normally engaged. The nose (14) then provides the holding of the contact in active position, and prevents the contact from being pushed backward when the bulb is engaged or when tension is applied on the power supply wires. The front part of the contact (13) further has a stop (16) which comes against a surface (17) of another light (18) provided on the tubular body (3).

Figure 3:
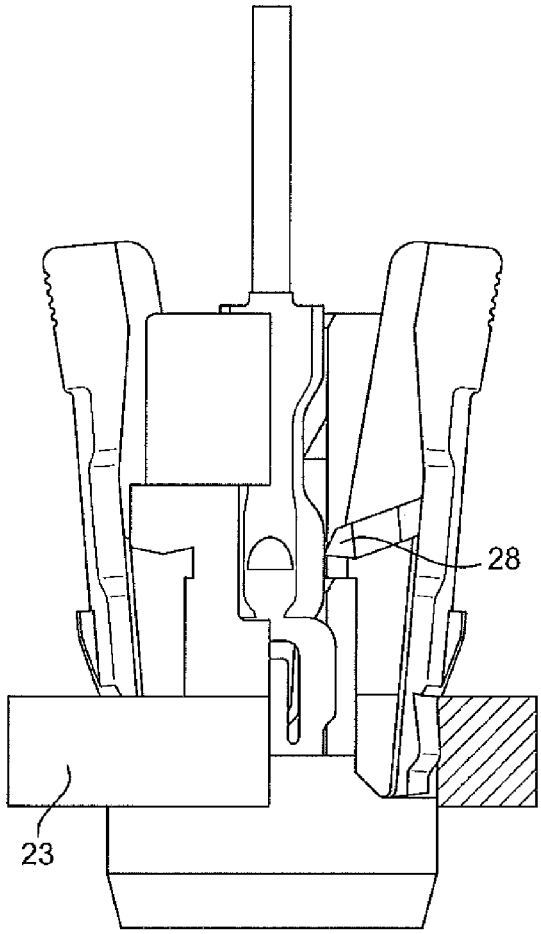
FIG. 3 shows a cutaway cross-sectional view of the socket, when the electrical contact is incorrectly engaged.

The elements (1, 2) are hinged at the level of a refined area (19, 20) forming a folding area. It has lugs (21, 22) providing the locking onto the base (23) of the headlight as shown in FIG. 3. To the rear of these elements (1, 2) is provided a gripping area (24, 25) for exerting a diametral force facilitating the removal of the socket from the base of the headlight, for example for the replacement of a faulty bulb. In addition, the elements have two hooks (26) engaging with two complementary areas (27) during the first activation, through the exertion of a diametral force on the gripping area (24, 25). The first activation occurs during the assembly, after the insertion and the locking of the contacts (7, 8).

Figure 2:
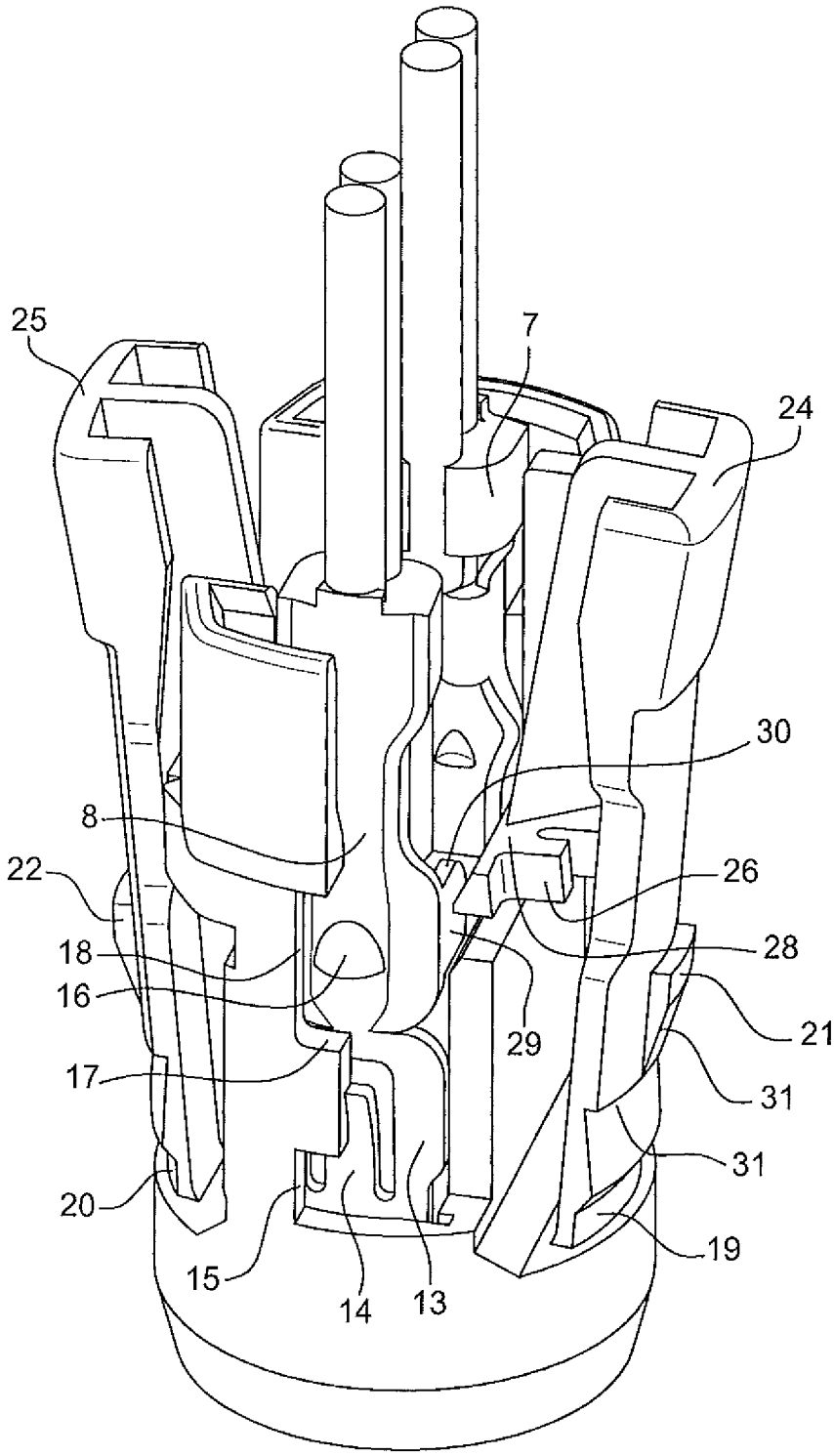
FIG. 2 shows a cutaway perspective view of the socket, when the electrical contact is incorrectly engaged.

The elements (1, 2) have on internal surface shoulders (28) thereof that can be seen in FIGS. 1 and 2, positioned to engage with a detection area (29) of the contacts (7, 8). The rear of the detection area (29) provides a retention area (30) abutting the shoulder (28) when the contact is correctly engaged and locked. Each contact is thus doubly locked, each of the elements detecting the positioning of one or both of the contacts, and also providing the locking of one or both of the contacts.

Operation of the Detection and Locking

FIG. 2 illustrates the situation when one of the contacts (8) is not completely engaged and is not locked. The locking nose (14) is not engaged in the housing (15), and the stop (16) is not against the surface (17) of the light (18). In this case, it is not possible to radially move the element (1) towards the axis of the socket because the shoulder (28) abuts the detection area (29) of the contact (8).

The consequences are:

the impossibility of clip-fastening at the level of the hook (26) the element (2) onto the complementary area (27); and the impossibility of engaging the body of the socket into the passage provided in the base (23) of the headlight, as shown in FIG. 3.

To amplify these consequences, the element (1, 2) has a shoulder (31) in front of the chamfer (32) preceding the lug (21).

Figure 4:
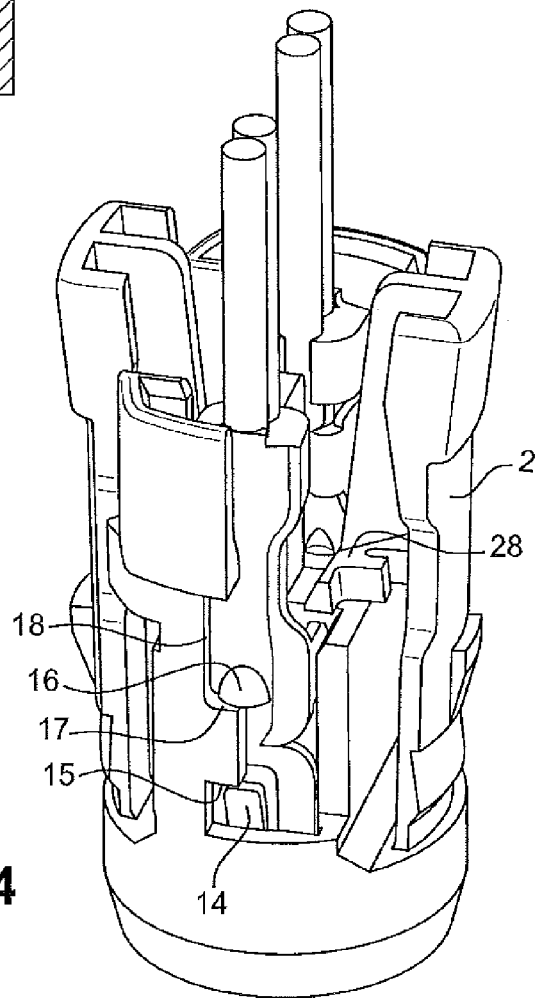
FIG. 4 shows a cutaway perspective view of the socket, when the electrical contact is correctly engaged.

When the contact is correctly engaged and locked, as shown in FIG. 4, the locking nose (14) is lodged into the housing (15) of the tubular body (3) and the stop (16) is pressed against the surface (17) of the light (18). In this configuration, the shoulder (28) of the element (8) passes behind the retention surfaces (30) of the contacts (7, 8), when a diametral biasing is exerted on the elements (1, 2). The four hooks (26) of the elements (1 and 2) are at the same time engaged against the four complementary areas (27). The elements (1, 2) are thus retained when they are accidentally biased towards the exterior, the movement thereof being limited to prevent the rupture by too high an amplitude resulting in excessive stresses on the folding areas (19, 20).

Figure 5:
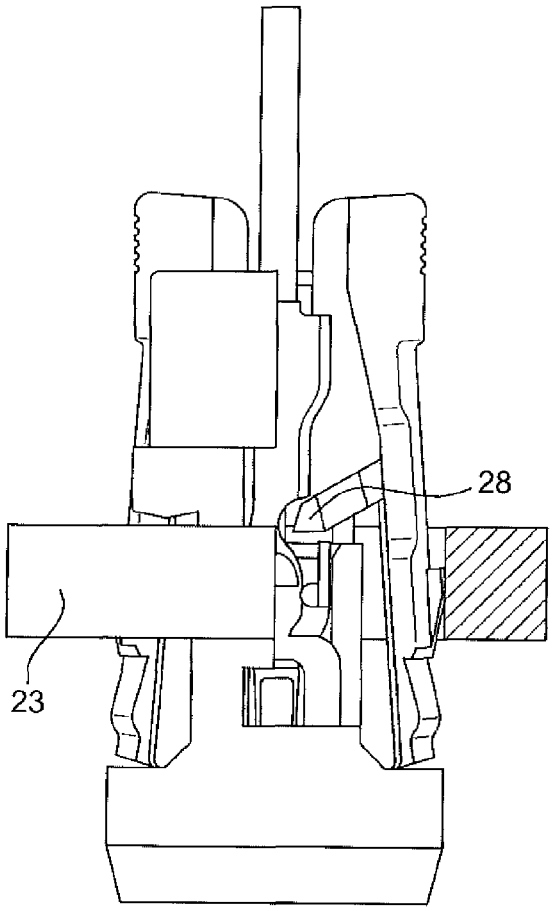
FIG. 5 shows a cutaway cross-sectional view of the socket, when the electrical contact is incorrectly engaged, during insertion into the headlight.
Figure 6:
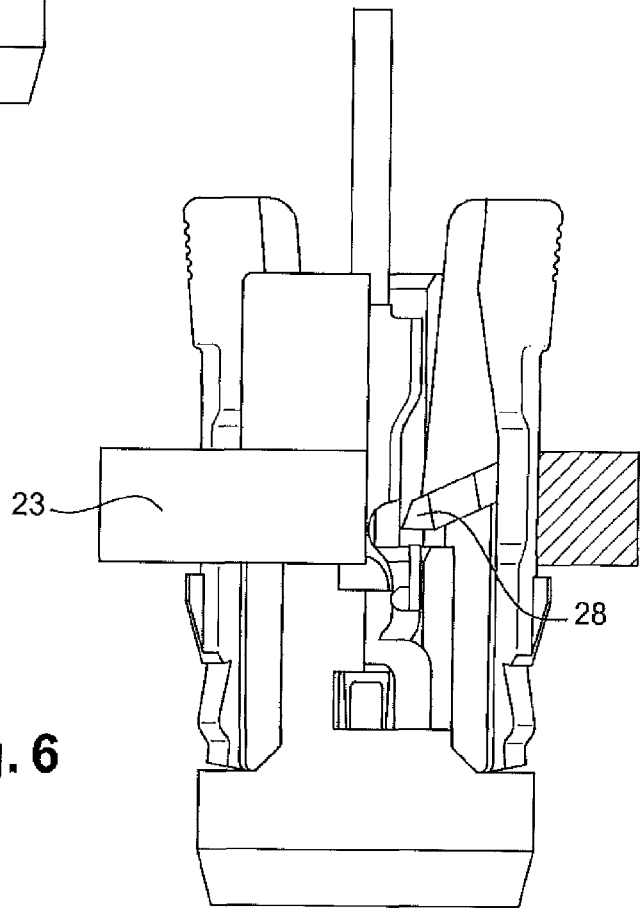
FIG. 6 shows a cutaway cross-sectional view of the socket, when the electrical contact is correctly engaged and the socket is engaged in the headlight.

FIG. 5 shows the socket (3) during the passage into the base (23). The shoulder (28) does not limit the travel of the element, which may deform sufficiently to enable the passage of the base (23) of the headlight. FIG. 6 shows the view of the socket in mounted position. The shoulder (28) provides a secondary locking of the contact and secures the mounting.

The invention claimed is:

1. A socket for an electric bulb comprising a tubular body having two longitudinal cavities operably receiving contacts crimped onto cables, the tubular body having lateral clip-fastening elements having lugs operably locking into the base of a motor vehicle light or headlight, the locking elements including internal shoulders the dimensions and the positioning of which are configured such as to be engaged behind a transverse surface of the contact when the contact is correctly mounted and when the elements are biased to enable insertion into the base of the light or headlight, and preventing the movement of the elements for the insertion of the socket when the contact is not correctly engaged.

2. A socket according to claim 1, wherein the shoulder of the element frees the passage of the cavity at rest.

3. A socket according to claim 1, wherein the shoulder of the element is configured to provide the locking of the contacts by the combination between the transverse surface in front of the shoulder and the transverse surface of the contact, when the contact is correctly engaged in the socket and when the socket is clip-fastened into the base of the light or headlight.

4. A socket according to claim 1, wherein the elements are moulded in an expanded position, and have resilient hooks engaging in a complementary area of the tubular body during the first transverse biasing on the elements.

5. A socket according to claim 1, wherein the elements are moulded in expanded position, and have rigid hooks engaging in a resilient complementary area of the tubular body during the first transverse biasing on the elements.

6. A socket according to claim 1, wherein the elements have a gripping area for exerting a diametral force facilitating the removal of the socket from the base of the headlight.

7. A socket according to claim 1, wherein the elements have a shoulder in front of a chamfer preceding the lug.

8. A socket according to claim 1, wherein the elements are hinged at the level of a refined area forming a folding area.

9. A socket according to claim 1, wherein the elements have lugs providing the locking onto the base of the headlight.

* * * * *